US011455000B2

(12) United States Patent
Ho et al.

(10) Patent No.: US 11,455,000 B2
(45) Date of Patent: Sep. 27, 2022

(54) BIAS CURRENT GENERATION CIRCUIT

(71) Applicant: REALTEK SEMICONDUCTOR CORPORATION, Hsinchu (TW)

(72) Inventors: Chun-Ta Ho, Hsinchu (TW); Chun-I Kuo, Hsinchu (TW); Shawn Min, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/182,267

(22) Filed: Feb. 23, 2021

(65) Prior Publication Data

US 2021/0263548 A1 Aug. 26, 2021

(30) Foreign Application Priority Data

Feb. 25, 2020 (TW) ..... 109106087

(51) Int. Cl.
*G05F 1/46* (2006.01)
*G05F 1/575* (2006.01)
(Continued)

(52) U.S. Cl.
CPC ..... *G05F 3/262* (2013.01); *G05F 1/445* (2013.01); *G05F 1/461* (2013.01); *G05F 1/575* (2013.01); *G05F 1/462* (2013.01); *G05F 1/463* (2013.01)

(58) Field of Classification Search
CPC ... G05F 1/575; G05F 1/461–463; G05F 3/262
See application file for complete search history.

(56) References Cited

U.S. PATENT DOCUMENTS 7,152,009 B2 12/2006 Bokui et al.
7,323,857 B2 * 1/2008 Sung ..... G05F 3/30 323/316
(Continued)

FOREIGN PATENT DOCUMENTS

CN 1504853 A 6/2004
CN 101609346 A 12/2009
(Continued)

OTHER PUBLICATIONS

OA letter of the counterpart CN application (appl. No. 202010137961.2) dated Mar. 18, 2022. Summary of the OA letter: 1. Claims 1-7 are unpatentable over D1 (CN101609346A), D2 (CN108664070A), and D3 (CN106796438A, also published as US20160094195A1). 2. Claims 8-10 are unpatentable over D1, D2, D3 and D4 (CN1504853A, also published as U.S. Pat. No. 7,152,009B2).

*Primary Examiner* — Sisay G Tiku
(74) *Attorney, Agent, or Firm* — WPAT, PC

(57) ABSTRACT

The present invention discloses a bias current generation circuit. An operation amplifier compares an input voltage having a zero-temperature coefficient and a feedback voltage to generate a driving voltage. An output transistor generates a bias current according to the driving voltage. A variable resistive circuit is electrically coupled to the output transistor through a feedback node to generate the feedback voltage according to the bias current and includes series-coupled resistors and switch transistors. Each of the resistors has a resistance having a positive temperature coefficient and includes a current input terminal and a current output terminal. Each of the switch transistors is electrically coupled between the current output terminal of one of the resistors and a ground terminal. One of the switch transistors turns on according to a control voltage variable according to
(Continued)

the temperature variation to enable resistors to generate the resistance having a negative temperature coefficient.

10 Claims, 3 Drawing Sheets

(51) Int. Cl.
*G05F 1/445* (2006.01)
*G05F 3/26* (2006.01)

(56) References Cited

U.S. PATENT DOCUMENTS 7,649,425 B2 * 1/2010 Nervegna ..... H03K 4/501 331/111
7,896,545 B2 * 3/2011 Pan ..... G01K 15/005 374/178
8,736,337 B2 * 5/2014 Yayama ..... H03L 7/00 327/293
8,816,668 B2 * 8/2014 Ryu ..... G11C 5/147 323/354
9,000,935 B2 * 4/2015 Dao ..... H04Q 9/00 340/636.17
9,250,642 B2 * 2/2016 Wu ..... G05F 1/561
9,996,099 B2 * 6/2018 Kimura ..... G05F 3/16
10,072,929 B2 * 9/2018 Higuchi ..... G01C 19/5628
10,236,872 B1 * 3/2019 Willard ..... H01L 25/0657
10,483,948 B2 * 11/2019 Sun ..... H03K 5/135
10,505,530 B2 * 12/2019 Ranta ..... H03K 17/6874
10,635,130 B2 * 4/2020 Ensafdaran ..... G06F 1/10
10,886,911 B2 * 1/2021 Willard ..... H01L 27/1203
10,938,199 B2 * 3/2021 Ye ..... H03K 17/145
11,048,285 B2 * 6/2021 Chien ..... G05F 1/468
11,262,861 B2 * 3/2022 Park ..... G09G 3/2096
2004/0108881 A1 * 6/2004 Bokui ..... H03L 7/099 327/334
2007/0088517 A1 * 4/2007 Bokui ..... H03L 7/099 702/107
2009/0234612 A1 * 9/2009 Bokui ..... H03L 7/099 702/107
2010/0237956 A1 * 9/2010 Miyashita ..... H03B 5/1243 331/185
2012/0126616 A1 * 5/2012 Hu ..... G05F 1/561 307/31
2012/0206161 A1 * 8/2012 Chang ..... G11C 29/48 324/762.09
2012/0326696 A1 * 12/2012 Chang ..... G05F 1/575 323/313
2014/0145702 A1 * 5/2014 Wu ..... G05F 1/561 323/315
2016/0094195 A1 * 3/2016 Du ..... H03F 3/193 330/254

FOREIGN PATENT DOCUMENTS

CN 102354238 A * 2/2012 ..... G05F 1/575
CN 106796438 A 5/2017
CN 108664070 A 10/2018
JP 2004194304 A * 7/2004 ..... H03L 7/093
WO WO-2016049288 A1 * 3/2016 ..... G05F 1/561

* cited by examiner

BIAS CURRENT GENERATION CIRCUIT

BACKGROUND OF THE INVENTION

1. Field of the Invention

The present invention relates to a bias current generation circuit.

2. Description of Related Art

In many electronic systems, a bias current generation circuit is required for providing a bias current for other circuits. The amount of current in an ideal bias current does not vary with temperature. However, in certain electronic systems, the bias current flows through an internal load resistor in the bias current generation circuit, in which the resistance of the internal load resistor varies along with the variation of the temperature. Under such a condition, the bias current can be affected by the internal load resistor and thus is not able to maintain a stable current amount even if the control voltage for generating the bias current is stable with respect to the temperature variations.

SUMMARY OF THE INVENTION

In consideration of the problem of the prior art, an object of the present invention is to supply a bias current generation circuit.

The present invention discloses a bias current generation circuit that includes an operation amplifier, an output transistor and a variable resistive circuit. The operation amplifier includes at least two input terminals and an output terminal, wherein the at least two input terminals are respectively configured to receive an input voltage having a zero-temperature coefficient and a feedback voltage, to generate a driving voltage at the output terminal according to a comparison result between the input voltage and the feedback voltage. The output transistor is configured to generate a bias current according to the driving voltage. The variable resistive circuit is electrically coupled to the output transistor through a feedback node to generate the feedback voltage according to the bias current.

These and other objectives of the present invention will no doubt become obvious to those of ordinary skill in the art after reading the following detailed description of the preferred embodiments that are illustrated in the various figures and drawings.

DETAILED DESCRIPTION OF THE PREFERRED EMBODIMENTS

An aspect of the present invention is to provide a bias current generation circuit to provide a precise bias current that is not affected by the temperature.

Figure 1:
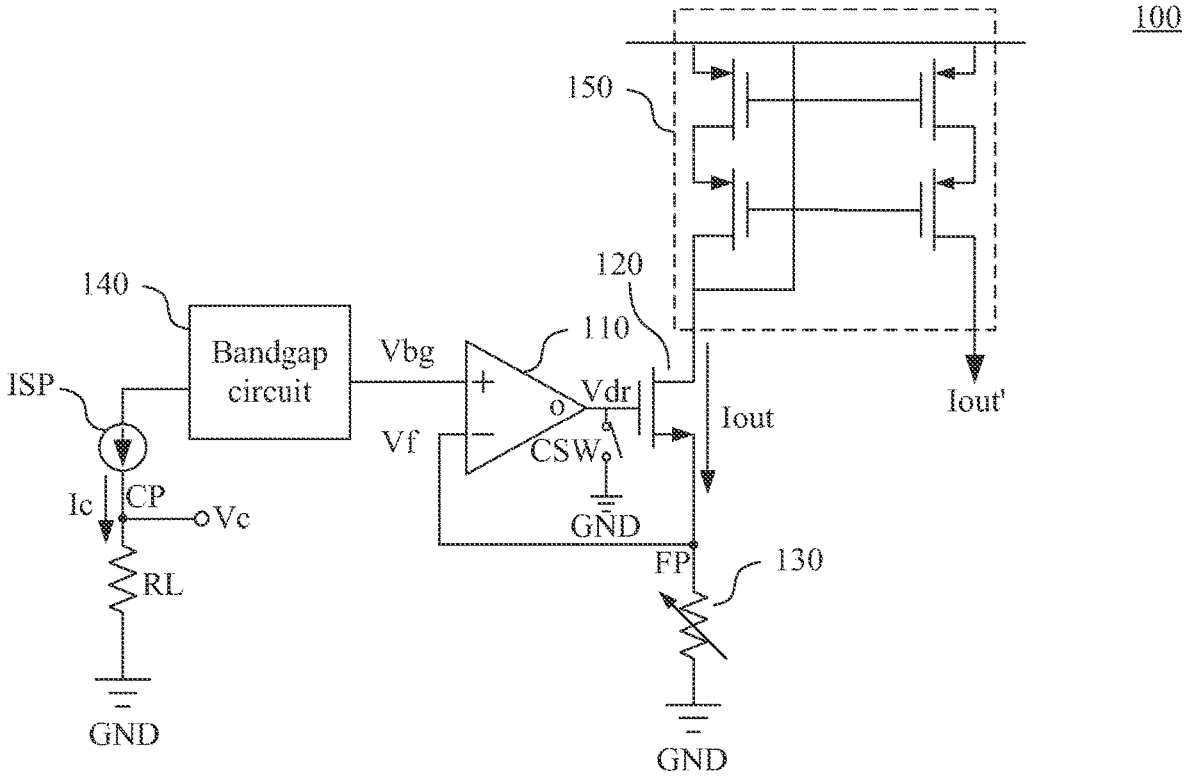
FIG. 1 illustrates a circuit diagram of a bias current generation circuit according to an embodiment of the present invention.

Reference is now made to FIG. 1. FIG. 1 illustrates a circuit diagram of a bias current generation circuit 100 under an operation mode according to an embodiment of the present invention. The bias current generation circuit 100 is configured to generate a bias current Iout that has a current amount that is precise and not affected by the temperature.

The bias current generation circuit 100 includes an operation amplifier 110, an output transistor 120 and a variable resistive circuit, wherein the variable resistive circuit is a variable resistor 130. In an embodiment, the operation amplifier 110, the output transistor 120 and the variable resistor 130 are disposed inside a single chip.

The operation amplifier 110 includes two input terminals and an output terminal. In FIG. 1, the two input terminals are respectively labeled by symbols '+' and '-'. The output terminal is labeled by a symbol of 'o'. The two input terminals are respectively configured to receive an input voltage Vbg having a zero-temperature coefficient and a feedback voltage Vf, to generate a driving voltage Vdr at the output terminal according to a comparison result between the input voltage Vbg and the feedback voltage Vf.

In an embodiment, the input voltage Vbg having the zero-temperature coefficient can be generated by a bandgap circuit 140 selectively included in the bias current generation circuit 100. The term "zero-temperature coefficient" means that the voltage amount of the input voltage Vbg does not change along with the variation of the temperature.

In the present embodiment, the output transistor 120 is an N-type transistor. However, under a proper modification, the output transistor 120 can also be implemented by a P-type transistor. The present invention is not limited thereto. In the present embodiment, the output transistor 120 includes a gate, a drain and a source. The gate is configured to receive the driving voltage Vdr, to generate the bias current Iout that flows from the drain to the source.

The variable resistor 130 is electrically coupled to the source of the output transistor 120 through the feedback node FP, to receive the bias current Iout and generate the feedback voltage Vf at the feedback node FP according to the bias current Iout.

In an embodiment, the bias current generation circuit 100 further includes a calibration switch CSW configured to electrically isolate the gate of the output transistor 120 from a ground terminal GND under the operation mode such that the gate receives the driving voltage Vdr.

Figure 2:
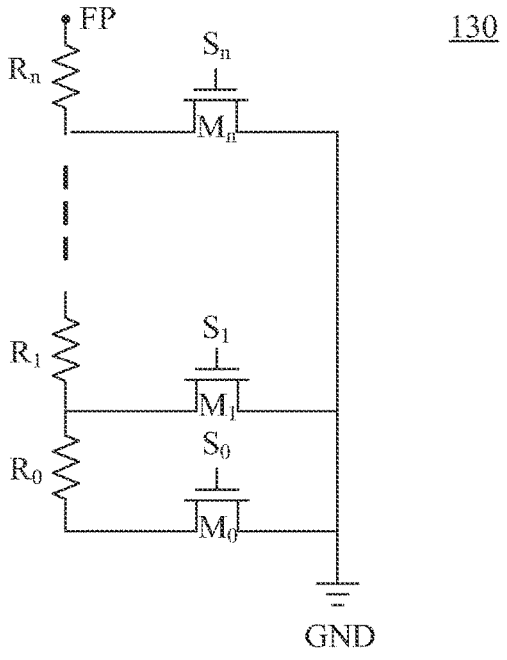
FIG. 2 illustrates a circuit diagram of the variable resistor according to an embodiment of the present invention.

Reference is now made to FIG. 2. FIG. 2 illustrates a circuit diagram of the variable resistor 130 according to an embodiment of the present invention.

The variable resistor 130 includes a plurality of resistors $R_0$~$R_n$ electrically coupled in series and a plurality of switch transistors $M_0$~$M_n$.

As illustrated in FIG. 2, each of the resistors $R_0$~$R_n$ includes a current input terminal and a current output terminal Each of the switch transistors $M_0$~$M_n$ is electrically coupled between the current output terminal of one of the resistors $R_0$~$R_n$ and the ground terminal GND. In the present embodiment, each of the switch transistors $M_0$~$M_n$ is implemented by an N-type transistor.

More specifically, the current input terminal of the resistor $R_n$ is electrically coupled to the feedback node FP, the current output terminal of the resistor $R_n$ is electrically coupled to the resistor $R_{n-1}$, and the drain and the source of the switch transistor $M_n$ are respectively electrically coupled to the current output terminal of the resistor $R_n$ and the ground terminal GND. The current input terminal of the resistor $R_{n-1}$ is electrically coupled to the current output terminal of the resistor $R_n$, the current output terminal of the resistor $R_{n-1}$ is electrically coupled to the resistor $R_{n-2}$, and the drain and the source of the switch transistor $M_{n-1}$ are respectively electrically coupled to the current output terminal of the resistor $R_{n-1}$ and the ground terminal GND, so on and so forth. Likewise, the current input terminal of the resistors $R_0$ is electrically coupled to the current output terminal of the resistors $R_1$ and the drain and the source of the switch transistor $M_n$ are respectively electrically coupled to the current output terminal of the resistor $R_0$ and the ground terminal GND.

The gates of the switch transistors $M_0$~$M_n$ are controlled by the signals $S_0$~$S_n$. Under the operation mode, one of the switch transistors $M_0$~$M_n$ turns on according to the control voltage Vc while the other switch transistors $M_0$~$M_n$ turn off, to enable a corresponding resistor.

More specifically, take the switch transistors $M_0$~$M_n$ each implemented by an N-type transistor as an example, in a usage scenario, the signal $S_1$ that the gate of the switch transistor $M_1$ receives is the control voltage Vc having a high voltage level such that the switch transistor $M_1$ turns on, and the signals $S_0$ and $S_2$~$S_n$ that the gates of the switch transistors $M_0$ and $M_2$~$M_n$ receive are the signals each having a low voltage level such that the switch transistors $M_0$ and $M_2$~$M_n$ turn off. Under such a condition, the resistors $R_1$~$R_n$ are enabled accordingly.

In another usage scenario, the signal $S_{n-1}$ that the gate of the switch transistor $M_{n-1}$ receives is the control voltage Vc having the high voltage level such that the switch transistor $Mn-1_1$ turns on, and the signals $S_0$~$S_{n-2}$ that the gates of the switch transistors $M_0$~$M_{n-2}$ receive are the signals each having a low voltage level such that the switch transistors $M_0$~$M_{n-2}$ turn off. Under such a condition, only the resistors $R_{n-1}$~$R_n$ are enabled accordingly.

As a result, when the location of the switch transistor that is selected to turn on is closer to the feedback node FP (more away from the ground terminal GND), less number of the resistors $R_0$~$R_n$ are enabled such that the total resistance of the variable resistor 130 is smaller. On the contrary, when the location of the switch transistor that is selected to turn on is more away from the feedback node FP (closer to the ground terminal GND), more number of the resistors $R_0$~$R_n$ are enabled such that the total resistance of the variable resistor 130 is larger.

In the present embodiment, each of the resistors $R_0$~$R_n$ has a load resistance having a positive-temperature coefficient. More specifically, when the temperature increases, the load resistance of each of the resistors $R_0$~$R_n$ increases accordingly.

As a result, at least one of the switch transistors $M_0$~$M_n$ turns on according to the control voltage Vc that is variable with the temperature change to have a transistor resistance having a negative-temperature coefficient. For the switch transistors $M_0$~$M_n$ each implemented by an N-type transistor, the control voltage Vc has the positive-temperature coefficient, in which the control voltage Vc increases when the temperature increases to further increase the turn-on degree of the switch transistors $M_0$~$M_n$. The transistor resistance thus decreases when the temperature increases.

As a result, the decreased amount of the transistor resistance generated due to the increase of the temperature can balance the increased amount of the load resistance generated due to the increase of the temperature. The total resistance of the variable resistor 130 can substantially have the zero-temperature coefficient that does not change along with the variation of the temperature.

It is appreciated that the term "substantially" means that the total resistance of the variable resistor 130 can be variable within a tolerable range instead of completely invariable against the temperature change. For example, the load resistance of each of the resistors $R_0$~$R_n$ may increase along with the variation of the temperature in a linear way and the transistor resistance of each of the switch transistors $M_0$~$M_n$ may decrease along with the variation of the temperature in a non-linear way. However, the increased amount of the load resistance generated due to the increase of the temperature and the decreased amount of the transistor resistance generated due to the increase of the temperature together keep the total resistance of the variable resistor 130 within a predetermined range. The total resistance of the variable resistor 130 does not vary drastically due to the variation of the temperature.

Under such a condition, since the total resistance of the variable resistor 130 has the zero-temperature coefficient, the feedback voltage Vf generated at the feedback node FP also has the zero-temperature coefficient. The operation amplifier 110 receives the input voltage Vbg and the feedback voltage Vf both having the zero-temperature coefficient through the two input terminals, to generate the driving voltage Vdr having the zero-temperature coefficient. Furthermore, the output transistor 120 is controlled by the driving voltage Vdr having the zero-temperature coefficient to generate the bias current Iout having the zero-temperature coefficient.

In an embodiment, the bias current Iout is outputted to an external circuit (not illustrated) through a current mirror 150 selectively included in the bias current generation circuit 100. The current mirror 150 can generate a bias current Iout' that is a multiple of the bias current Iout according to the ratio of the sizes of the transistors in different branches therein. It is appreciated that since the bias current Iout has the zero-temperature coefficient, the bias current Iout' can also have the zero-temperature coefficient.

Since each of the switch transistors $M_0$~$M_n$ in the embodiment described above is implemented by the N-type transistor, the bias current generation circuit 100 may selectively include a load resistor RL and a positive-temperature coefficient current source ISP. The load resistor RL is electrically coupled between the control terminal CP and the ground terminal GND. The positive-temperature coefficient current source ISP is electrically coupled to the control terminal CP and is configured to provide a control current Ic having the positive-temperature coefficient to the load resistor RL according to the operation of the bandgap circuit 140. The control voltage Vc is thus generated at the control terminal CP such that the control voltage Vc has the positive-temperature coefficient.

In another embodiment, each of the switch transistors $M_0$~$M_n$ is implemented by a P-type transistor. One of the signals $S_0$~$S_n$ received by the gates of the switch transistors $M_0$~$M_n$ is the control voltage Vc having a low voltage level while each of the other signals $S_0$~$S_n$ has the high voltage level. Accordingly, one of the switch transistors $M_0$~$M_n$ turns on while the other switch transistors $M_0$~$M_n$ turn off.

Under such a condition, the control voltage Vc has the negative-temperature coefficient so as to decrease along with the increase of the temperature to further increase the turn-on degree of the switch transistors $M_0$~$M_n$ each implemented by the P-type transistor. The transistor resistance of each of the switch transistors $M_0$~$M_n$ thus decreases along with the increase of the temperature. Under such a condition, other circuits can be used in the bias current generation circuit 100 to provide the control voltage Vc having the negative-temperature coefficient.

Figure 3:
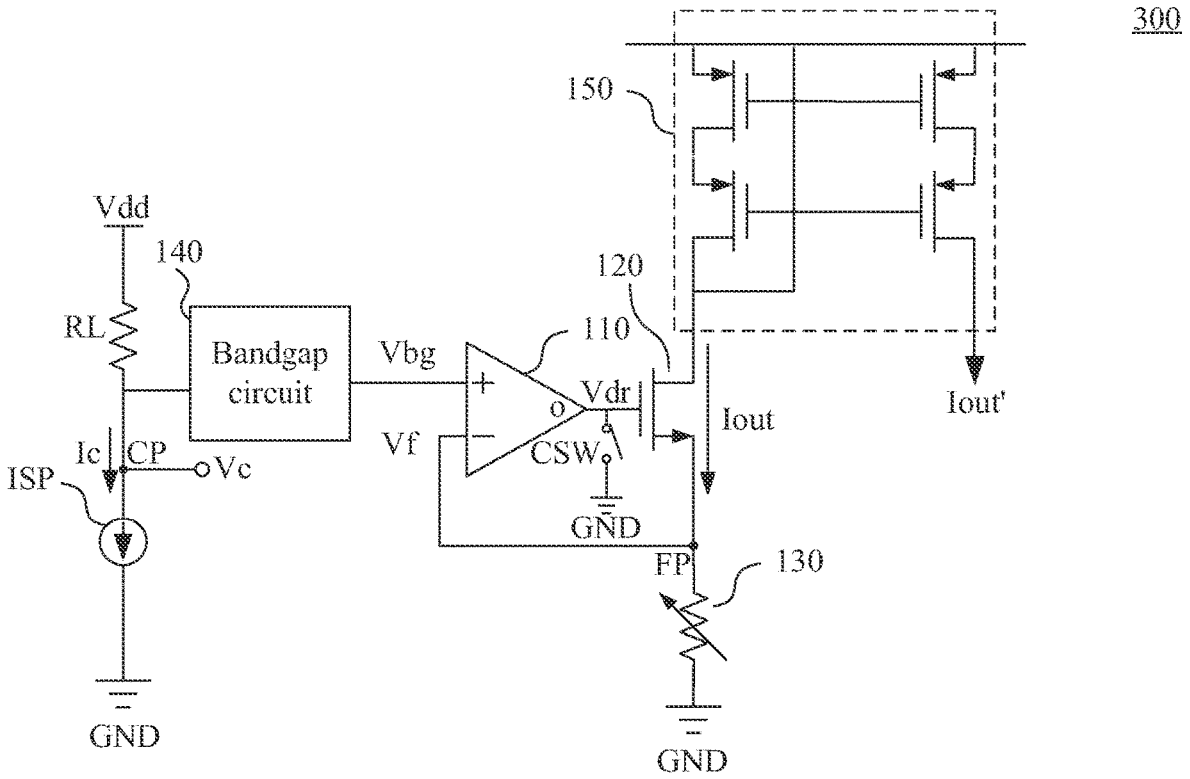
FIG. 3 illustrates a circuit diagram of a bias current generation circuit according to an embodiment of the present invention.

Reference is now made to FIG. 3. FIG. 3 illustrates a circuit diagram of a bias current generation circuit 300 according to an embodiment of the present invention. Identical to the bias current generation circuit 100 illustrated in FIG. 1, the bias current generation circuit 300 includes the operation amplifier 110, the output transistor 120 and the variable resistor 130.

In the present embodiment, the bias current generation circuit 100 also includes the load resistor RL and the positive-temperature coefficient current source ISP. However, the load resistor RL is electrically coupled between the voltage source Vdd and the control terminal CP. The positive-temperature coefficient current source ISP is electrically coupled between the control terminal CP and the ground terminal GND, and is configured to provide the control current Ic having the positive-temperature coefficient according to the operation of the bandgap circuit 140.

Since the control current Ic is the current drained from the control terminal CP, the draining ability increases along with the increase of the temperature such that the voltage of the control terminal CP decreases. As a result, the control current Ic can generate the control voltage Vc having the negative-temperature coefficient at the control terminal CP to control the switch transistors $M_0$~$M_n$ each implemented by a P-type transistor.

In an embodiment, the total resistance of the variable resistor 130 in the bias current generation circuit 100 can be determined in the calibration mode and the variable resistor 130 keeps the determined total resistance in the operation mode.

Figure 4:
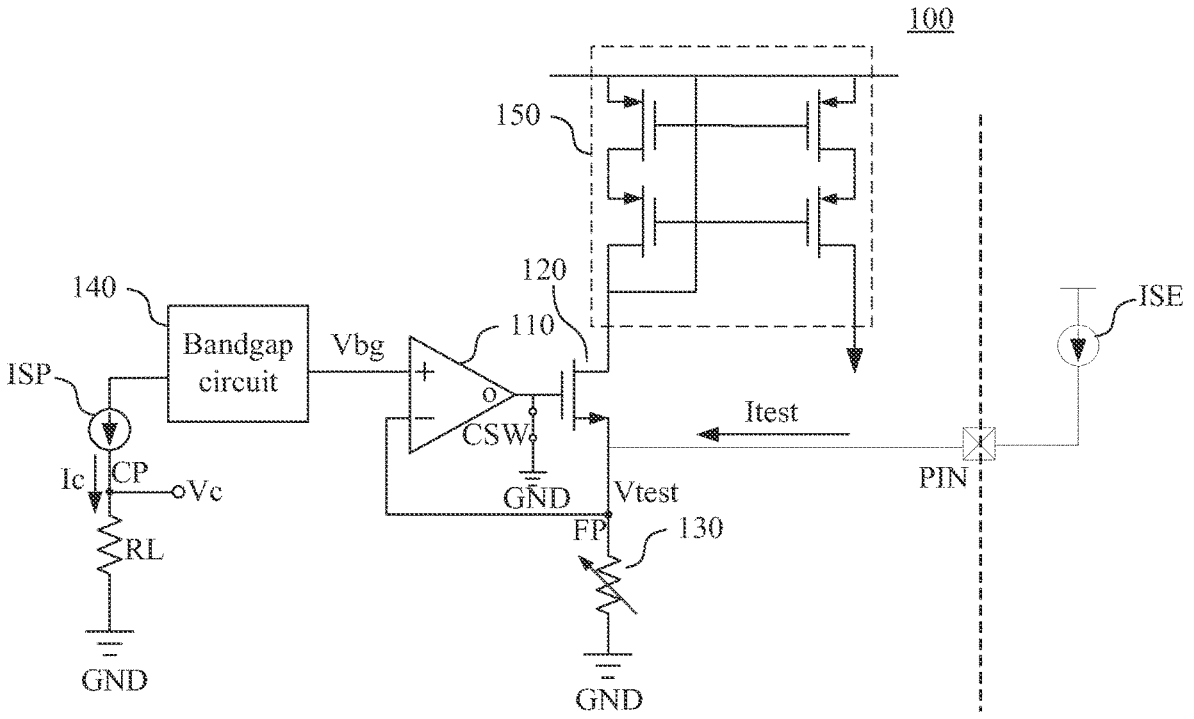
FIG. 4 illustrates a circuit diagram of the bias current generation circuit under the calibration mode according to an embodiment of the present invention.

Reference is now made to FIG. 4. FIG. 4 illustrates a circuit diagram of the bias current generation circuit 100 under the calibration mode according to an embodiment of the present invention.

In an embodiment, the bias current generation circuit 100 further includes a calibration switch CSW. The calibration switch CSW is configured to electrically couple the gate of the output transistor 120 to the ground terminal GND in the calibration mode. Under such a condition, the feedback node FP is further configured to receive a calibration current $I_{test}$ to generate a voltage $V_{test}$ at the feedback node FP according to the total resistance of the variable resistor 130.

In an embodiment, the calibration current $I_{test}$ is provided by a current source ISE and the current source ISE is disposed in a chip different than the chip that the bias current generation circuit 100 locates. The calibration current $I_{test}$ can be transmitted to the feedback node FP through such as, but not limited to a pin PIN.

Under such a condition, a target voltage can be set according to a manufacturing process deviation parameter. The variable resistor 130 can use the signals $S_0$~$S_n$ to control the switch transistors $M_0$~$M_n$ to modify the total resistance under the condition that the calibration current $I_{test}$ does not change to further modify the voltage $V_{test}$ until the total resistance determined by one of the switch transistors selected to turn on makes the voltage $V_{test}$ equal to the target voltage.

As a result, when the total resistance of the variable resistor 130 is determined in the calibration mode, the bias current generation circuit 100 returns to the operation mode illustrated in FIG. 1. The calibration switch CSW electrically isolates the gate of the output transistor 120 from the ground terminal GND to receive the driving voltage Vdr. The variable resistor 130 operates according to the switch transistor selected to turn on to cancel out the effect of both the manufacturing process deviation and the temperature deviation.

It is appreciated that the embodiments described above are merely an example. In other embodiments, it should be appreciated that many modifications and changes may be made by those of ordinary skill in the art without departing, from the spirit of the disclosure.

In summary, the bias current generation circuit can adaptively modify the resistance of the variable resistor according to the variation of the temperature to provide the feedback mechanism used to control the bias current. The bias current that is precise and unaffected by the temperature can be produced.

The aforementioned descriptions represent merely the preferred embodiments of the present invention, without any intention to limit the scope of the present invention thereto. Various equivalent changes, alterations, or modifications based on the claims of present invention are all consequently viewed as being embraced by the scope of the present invention.

What is claimed is:

1. A circuit, comprising:

an operation amplifier comprising at least two input terminals and an output terminal, wherein the at least two input terminals are respectively configured to receive an input voltage having a zero-temperature coefficient and a feedback voltage to generate a driving voltage at the output terminal according to a comparison result between the input voltage and the feedback voltage;

an output transistor configured to generate a bias current according to the driving voltage; and a variable resistive circuit electrically coupled to the output transistor through a feedback node and configured to generate the feedback voltage according to the bias current, wherein the variable resistive circuit comprises:

a plurality of resistors electrically coupled in series each having a load resistance and a positive-temperature coefficient and each having a current input terminal and a current output terminal; and a plurality of switch transistors each electrically coupled between the current output terminal of one of the resistors and a ground terminal, wherein one of the switch transistors turns on according to a control voltage variable with a temperature change to enable the corresponding one of the resistors and generates a transistor resistance having a negative temperature coefficient.

2. The circuit of claim 1, wherein an increased amount of the load resistance of each of the resistors generated due to the increase of the temperature and a decreased amount of the transistor resistance generated due to the increase of the temperature together keep a total resistance of the variable resistive circuit within a predetermined range.

3. The circuit of claim 1, further comprising a bandgap circuit configured to generate the input voltage having the zero-temperature coefficient.

4. The circuit of claim 3, wherein each of the switch transistors is an N-type transistor and the circuit further comprises:

a load resistor electrically coupled between a control terminal and the ground terminal; and a positive-temperature coefficient current source electrically coupled to the control terminal and configured to provide a control current having the positive-temperature coefficient according to the operation of the bandgap circuit to the load resistor to generate the control voltage at the control terminal, wherein the control voltage has the positive-temperature coefficient.

5. The circuit of claim 3, wherein each of the switch transistors is a P-type transistor and the circuit further comprises:

a load resistor electrically coupled between a voltage source and the control terminal; and a positive-temperature coefficient current source electrically coupled between the control terminal and the ground terminal and configured to provide a control current having the positive-temperature coefficient according to the operation of the bandgap circuit to generate the control voltage at the control terminal, wherein the control voltage has the negative-temperature coefficient.

6. The circuit of claim 1, wherein the output transistor comprises a gate configured to receive the driving voltage, and the circuit further comprises a calibration switch configured to electrically couple the gate to the ground terminal under a calibration mode and to electrically isolate the gate from the ground terminal to receive the driving voltage under an operation mode.

7. The circuit of claim 6, wherein the feedback node is further configured to receive a calibration current under the calibration mode and control one of the switch transistors to turn one under the calibration mode such that a total resistance of the variable resistive circuit makes a voltage at the feedback node generated according to the calibration current equals to a target voltage.

8. The circuit of claim 7, wherein the target voltage is set according to a manufacturing process deviation parameter.

9. The circuit of claim 1, wherein the bias current is outputted to an external circuit through a current mirror.

10. The circuit of claim 1, wherein the operation amplifier, the output transistor and the variable resistive circuit are disposed inside a single chip.

* * * * *